US010563830B2

(12) United States Patent
Kovalchick et al.

(10) Patent No.: US 10,563,830 B2
(45) Date of Patent: Feb. 18, 2020

(54) LIGHT ASSEMBLY WITH PASS-THROUGH CONTROLS

(71) Applicant: Spring City Electrical Manufacturing Company, Spring City, PA (US)

(72) Inventors: Daniel A. Kovalchick, Sinking Spring, PA (US); Michael Greck, Coatesville, PA (US)

(73) Assignee: Spring City Electrical Manufacturing Company, Spring City, PA (US)

( * ) Notice: Subject to any disclaimer, the term of this patent is extended or adjusted under 35 U.S.C. 154(b) by 0 days.

(21) Appl. No.: 16/240,269

(22) Filed: Jan. 4, 2019

(65) Prior Publication Data

US 2019/0211984 A1 Jul. 11, 2019

Related U.S. Application Data

(60) Provisional application No. 62/614,688, filed on Jan. 8, 2018.

(51) Int. Cl.

| | |
|---|---|
| ***F21S 8/08*** | (2006.01) |
| ***F21S 2/00*** | (2016.01) |
| ***F21V 15/01*** | (2006.01) |
| ***F21V 29/70*** | (2015.01) |
| ***F21V 7/28*** | (2018.01) |
| ***F21V 29/508*** | (2015.01) |
| ***F21V 23/00*** | (2015.01) |

(Continued)

(52) U.S. Cl.

CPC ..... *F21S 8/083* (2013.01); *F21S 2/005* (2013.01); *F21S 8/088* (2013.01); *F21V 7/28* (2018.02); *F21V 15/01* (2013.01); *F21V 23/009* (2013.01); *F21V 29/508* (2015.01); *F21V 29/70* (2015.01); *F21Y 2105/10* (2016.08); *F21Y 2115/10* (2016.08)

(58) Field of Classification Search

CPC .. F21S 8/083; F21S 8/088; F21S 8/085; F21S 2/005; F21V 29/70; F21V 7/28

See application file for complete search history.

(56) References Cited

U.S. PATENT DOCUMENTS 3,141,620 A * 7/1964 Guggemos ..... F21S 8/083 362/220
3,343,322 A * 9/1967 Lurkis ..... E04H 12/003 52/298

(Continued)

*Primary Examiner* — Jong-Suk (James) Lee
*Assistant Examiner* — Christopher E Dunay
(74) *Attorney, Agent, or Firm* — Drinker Biddle & Reath LLP

(57) ABSTRACT

A split luminaire having at least two sections that attach to one another, each section including an outer light transmitting cover and a housing. The housing includes partition with a rear side including a recess that extends upward from a bottom to a top edge of the housing. The recess defines a conduit through the assembled housings that is open on its top and bottom. A hollow tubular support is located within the conduit and permits wiring, cabling and/or other components to extend through the luminaire from the pole to above the housings. The tubular support has an upper and lower flanges. The upper flange provides a point for attachment of electrical components above the luminaire and the lower flange is attached to the top of a pole. One or more light sources are mounted within the luminaire.

17 Claims, 6 Drawing Sheets

(51) Int. Cl.
*F21Y 105/10* (2016.01)
*F21Y 115/10* (2016.01)

(56) References Cited

U.S. PATENT DOCUMENTS

| | | | | |
|---|---|---|---|---|
| 6,598,842 | B1 * | 7/2003 | Yeh | A63H 33/40 248/159 |
| 8,442,242 | B2 * | 5/2013 | Harwood | G10K 11/28 181/176 |
| 8,684,571 | B1 * | 4/2014 | Alaura | F21S 8/083 362/431 |
| 9,343,887 | B2 * | 5/2016 | Butler | H02G 1/06 |
| 10,364,972 | B1 * | 7/2019 | Breedlove, Sr. | F21V 23/002 |
| 2004/0070985 | A1 * | 4/2004 | Haddad | E04H 12/02 362/431 |
| 2004/0223334 | A1 * | 11/2004 | McBride | F21S 8/081 362/457 |
| 2005/0285011 | A1 * | 12/2005 | Harwood | E04H 12/2261 248/519 |
| 2009/0168438 | A1 * | 7/2009 | Haddad | F21S 8/088 362/363 |
| 2009/0213592 | A1 * | 8/2009 | Zhang | F21S 8/083 362/249.02 |
| 2009/0268453 | A1 * | 10/2009 | Pearse | F21V 7/0025 362/235 |
| 2010/0061091 | A1 * | 3/2010 | Galipeau | F21S 8/088 362/234 |
| 2010/0128475 | A1 * | 5/2010 | Kovalchick | F21S 8/088 362/235 |
| 2014/0293601 | A1 * | 10/2014 | Beausoleil | F21V 21/088 362/235 |
| 2016/0290619 | A1 * | 10/2016 | Galloppa | F21V 21/116 |
| 2018/0172229 | A1 * | 6/2018 | Lockwood | H02S 30/20 |
| 2018/0356082 | A1 * | 12/2018 | Huffman, Jr. | F21V 23/002 |

* cited by examiner

LIGHT ASSEMBLY WITH PASS-THROUGH CONTROLS

RELATED APPLICATION

The present application claims priority to U.S. Provisional Application 62/614,688, filed Jan. 8, 2018, the disclosure of which is incorporated herein by reference in its entirety.

FIELD OF THE INVENTION

The present invention is directed to luminaires and light assemblies, and more particularly to a light assembly with electrical controls that pass through the lighting fixture.

BACKGROUND

Conventional lamp posts include an electrical base cabinet mounted on the ground with a tubular pole attached to and extending upward from the top of the cabinet. A luminaire is mounted at the upper end of the pole, either directly to the top end of the pole or on a laterally extending arm. For luminaires mounted to the top of the pole, such as acorn shaped luminaries, the electrical wiring enter and generally terminate at the base of the luminaire. Because you can see through the luminaire, it is not possible or desirable to run electronics or any electrical wiring through the luminaire out through its top.

In addition, it is not possible to mount heavy electrical components above or on the globe of a pole mounted luminaire since the material from which the globe is made is typically plastic material, such as polycarbonate, which cannot support heavy loads. For example, it would not be possible to mount an antenna, which can weigh upwards of 50 to 100 pounds, to the top of globe on a conventional pole mounted luminaire.

A need, therefore, exists for an improved lighting assembly which permits electrical communications to pass through the light fixture between its top and bottom.

SUMMARY OF THE INVENTION

A split luminaire for mounting on top of a post is disclosed. The luminaire includes at least two sections that attach to one another. Each section including an outer light transmitting cover which is at least partially transparent or translucent, and a housing. The cover is removably attached to the housing and preferably made from glass or plastic material. The housing has a back partition with a front side and a rear side, the front side facing outward toward the cover. The rear side of the partition in at least one of the housings includes a recess that extends upward from a bottom edge of the housing to a top edge of the housing. The recess forms a channel though the housing. When the housings are assembled the channel defines a conduit through the assembled housings and the luminaire, the conduit having an open top and bottom. The conduit is configured to permit wiring, cabling and/or other components to extend through the luminaire to the top edge of the housings.

In an embodiment a tubular support is located within the conduit. The tubular support includes upper and lower flanges, the upper flange located on or above a top of the luminaire and the lower flange located below a bottom of the luminaire. The upper flange is configured for attachment of electrical components above the luminaire.

One or more light sources are mounted within the luminaire and positioned to emit light toward the cover.

In an embodiment, the split luminaire is mounted to a light pole.

A light post assembly is also disclosed for permitting wiring and other electrical components and communications to extend through a top-mounted luminaire, the assembly includes a long hollow pole adapted to be mounted to an electrical base cabinet. The pole includes an open top which permits wiring, cabling or other electrical or power transmission or communication to pass out from an interior of the pole.

The assembly includes a split luminaire with at least two sections that attach to one another, each section including an outer light transmitting cover which is at least partially transparent or translucent, and a housing. The cover is removably attached to the housing. The housing has a back partition with a front side and a rear side, the front side facing outward toward the cover. The rear side of the partition in at least one of the housings includes a recess that extends upward from a bottom edge of the housing to a top edge of the housing. The recess forms a channel though the housing. The channels of the assembled housings define a conduit through the housings and the luminaire. The conduit is open on its top and bottom and located in the luminaire so as to align with the open top of the pole. The conduit is configured to permit wiring, cabling and/or other components to extend from the pole through the luminaire to the top edge of the housings.

In an embodiment a tubular support is located within the conduit. The tubular support includes upper and lower flanges, the upper flange located on or above a top of the luminaire and the lower flange located below a bottom of the luminaire. The upper flange is configured for attachment of electrical components above the luminaire.

In an embodiment, the housings are hingedly mounted to the upper and lower flanges of the tubular support so as to permit the housings to be independently pivoted away from the tubular support to permit access to the center portion of the tubular support and the wiring contained therein.

One or more light sources are mounted within the luminaire and positioned to emit light toward the cover.

In an embodiment, the flanged mounts are located on opposite ends of a tube that extends through the conduit.

Seals may be located between each cover and the bottom flanged mount to prevent water entry into the luminaire.

In one embodiment, each housing has a channel formed in its rear side and the assembled housings form, in combination, the conduit through the luminaire.

The housings of the sections are preferably substantially identical to one another.

The front side of the back partition of the housing is preferably coated with a white or reflective material to facilitate light reflection.

Each housing may include one or more chambers for mounting electrical components.

The one of more light sources are preferably LED arrays mounted on a shelf or bracket extending laterally outward from the back partition of at least one housing.

In another embodiment, a light post assembly is disclosed for permitting wiring and other electrical components and communications to extend through a top-mounted luminaire. The assembly includes a long hollow pole adapted to be mounted to an electrical base cabinet. The pole has an open top which permits wiring, cabling or other electrical or power transmission or communication to pass out from an interior of the pole.

In this embodiment a split luminaire has at least two sections that attach to one another, each section includes an outer light transmitting cover made from glass or plastic material which is at least partially transparent or translucent, and a housing. The cover is removably attached to the housing. The housing has a back partition with a front side and a rear side, the front side facing outward toward the cover and coated with a white or reflective material to facilitate light reflection. The rear side of each of the partitions includes a recess that extends upward from a bottom edge of the housing to a top edge of the housing. Each recess forms a channel though the housing, the channels of the housings in combination defining a conduit through the assembled housings and the luminaire. The conduit is open on its top and bottom and located in the luminaire so as to align with the open top of the pole. The conduit permits wiring, cabling and/or other components to extend from the pole through the luminaire to the top edge of the housings.

In an embodiment a tubular support is located within the conduit. The tubular support includes upper and lower flanges, the upper flange located on or above a top of the luminaire and the lower flange located below a bottom of the luminaire. The upper flange is configured for attachment of electrical components above the luminaire.

In an embodiment, the housings are hingedly mounted to the upper and lower flanges of the tubular support so as to permit the housings to be independently pivoted away from the tubular support to permit access to the center portion of the tubular support and the wiring contained therein.

Seals are located between each cover and the bottom flanged mount to prevent water entry into the luminaire or the pole.

A plurality of LED light sources are mounted within the luminaire and positioned to emit light toward the cover. At least one of the light sources is mounted on a shelf or bracket extending laterally outward from the back partition of at least one housing. The shelf or bracket has an angled mounting surface upon which the light source is mounted so as to emit light in at least a downward direction.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE INVENTION

Figure 1:
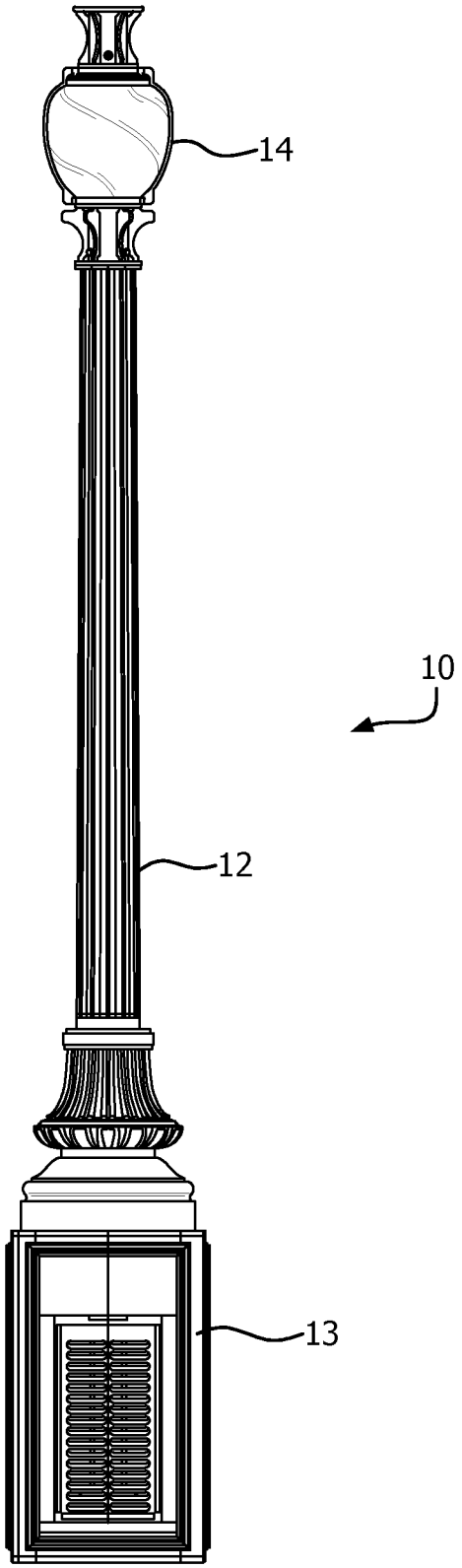
FIG. 1 is a front view of a light pole assembly according to the present invention with a split luminaire mounted on top.
Figure 2:
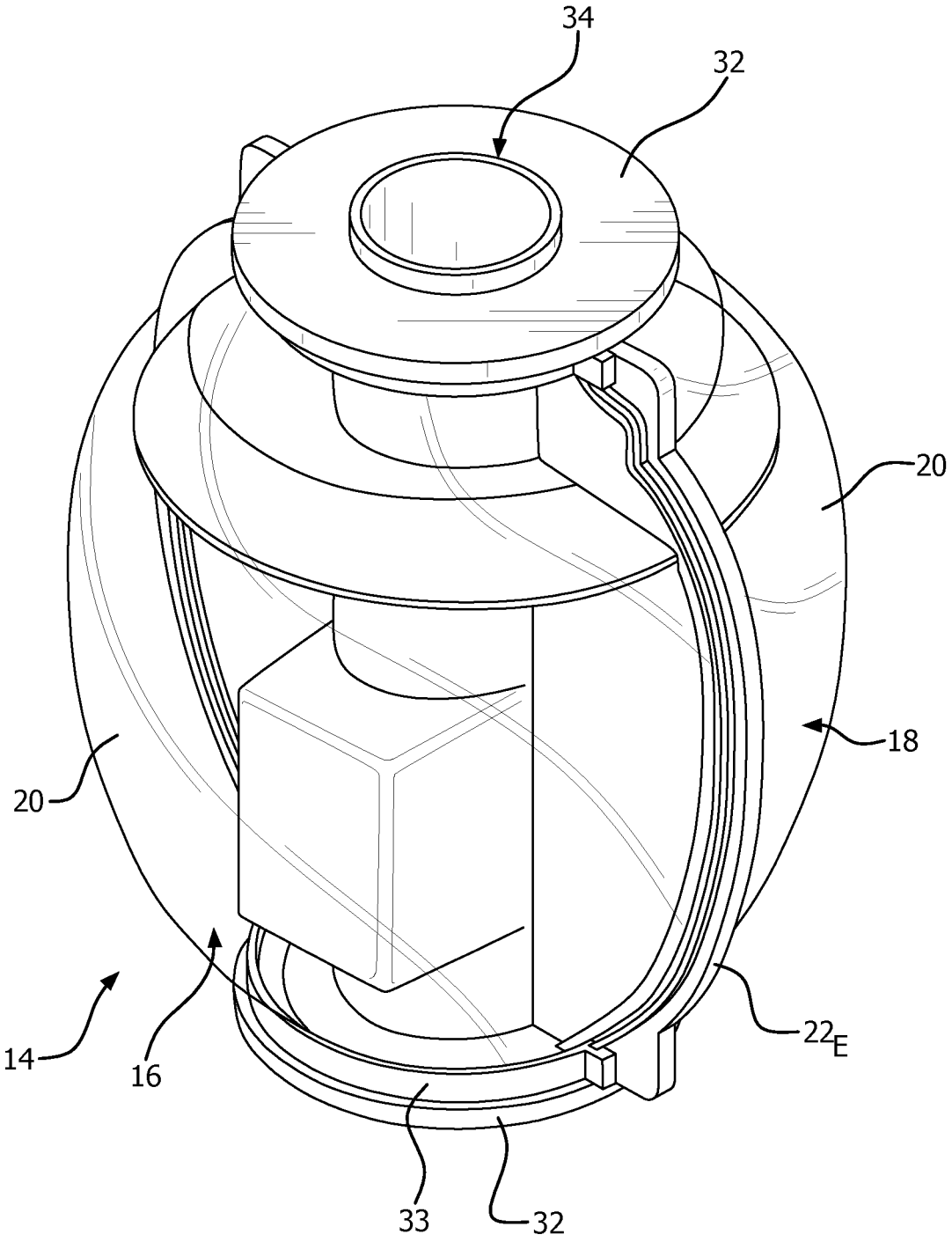
FIG. 2 is a top perspective view of the split luminaire of FIG. 1.
Figure 3:
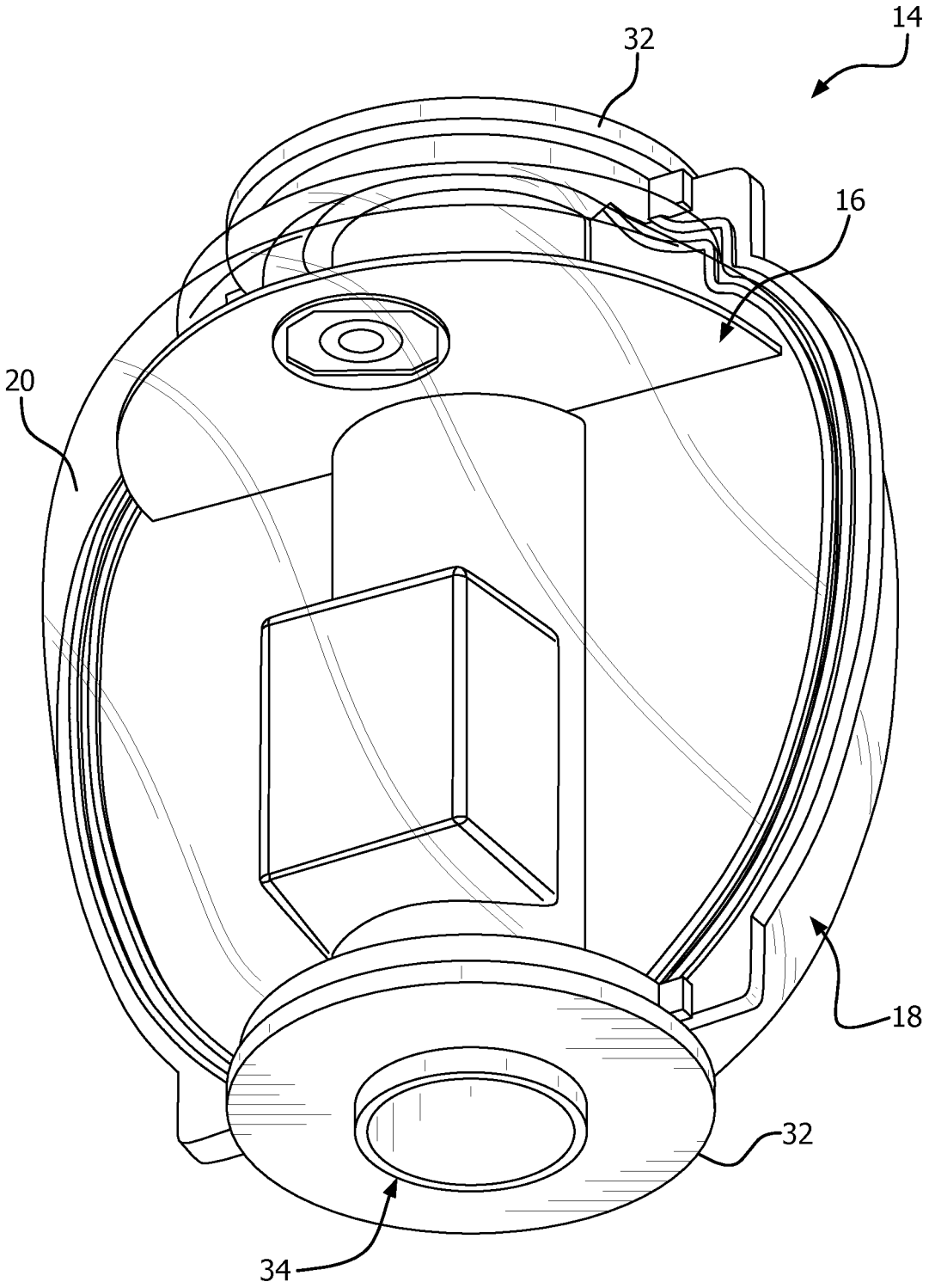
FIG. 3 is a bottom perspective view of the split luminaire of FIG. 1.
Figure 4:
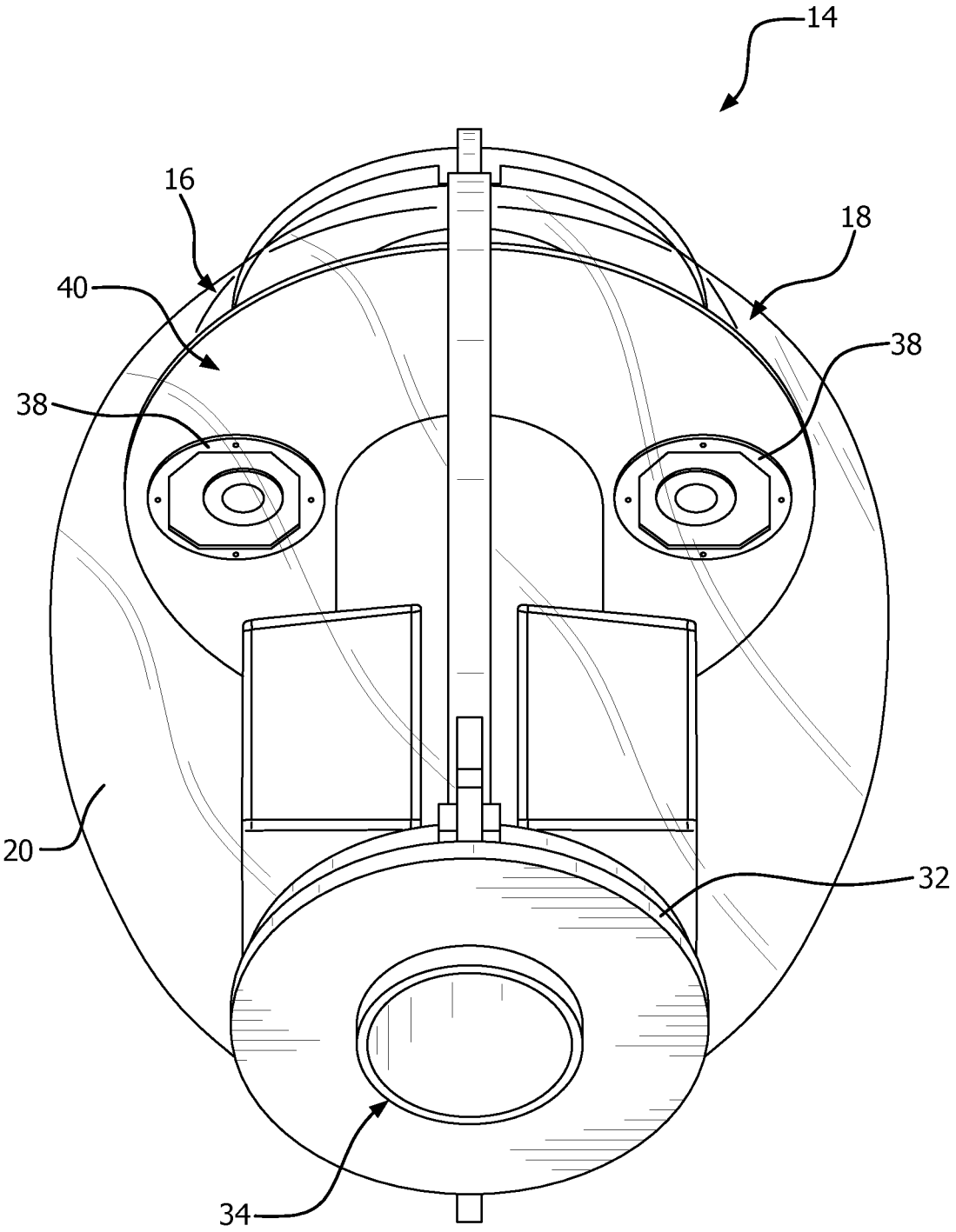
FIG. 4 is another bottom perspective view at a different angle than FIG. 3 of the split luminaire of FIG. 1.

The present invention is directed to a light post assembly 10 that permits wiring and other electrical components and communications to extend through a top-mounted luminaire so as to permit electrical power, communications or transmissions above the luminaire and for supporting top mounted electrical components. The light post assembly 10 includes a long hollow pole 12 and a split luminaire 14. The pole 12 is adapted to be mounted to an electrical base cabinet 13 and is conventional. The pole 12 includes an open top which permits wiring, cabling or other electrical or power transmission or communication to pass out from the interior of the pole.

The luminaire 14 is separated into at least two sections which are shown in the figures as first and second sections 16, 18. Each section includes an outer light transmitting cover 20 which is at least partially transparent or translucent. The cover 20 may be made from glass or, more preferably, plastic material such as polycarbonate. The cover 20 is removably attached to a housing 22. The housing 22 has a back portion 24 with a front side 26 and a rear side 28. The front side 26 faces outward toward the cover 20 and may be coated with a white or reflective material to facilitate light reflection. The rear side 28 includes a recess 30 that extends upward from a bottom edge of the housing to a top edge of the housing, thus forming a channel though the housing 22. As shown the housings 22 of the first and second sections 16, 18 may be substantially identical to one another such that the channels 30 form, in combination, a conduit 31 through the assembled housings 22 and luminaire 14.

It is contemplated that in certain embodiments only one of the luminaire sections 16, 18 may have a channel 30 that forms the conduit 31 through the luminaire. However it is preferable that the luminaire sections are mirror images of one another with each having a channel 30 that, in combination, form the conduit 31. In the illustrated embodiment, the channels 30 have a semi-cylindrical shape, however other shapes may be used. The conduit is located in the luminaire so as to align with the open top of the pole. The conduit 31 permits wiring, cabling and/or other components to extend from the pole into and/or through the luminaire to its top.

Figure 6:
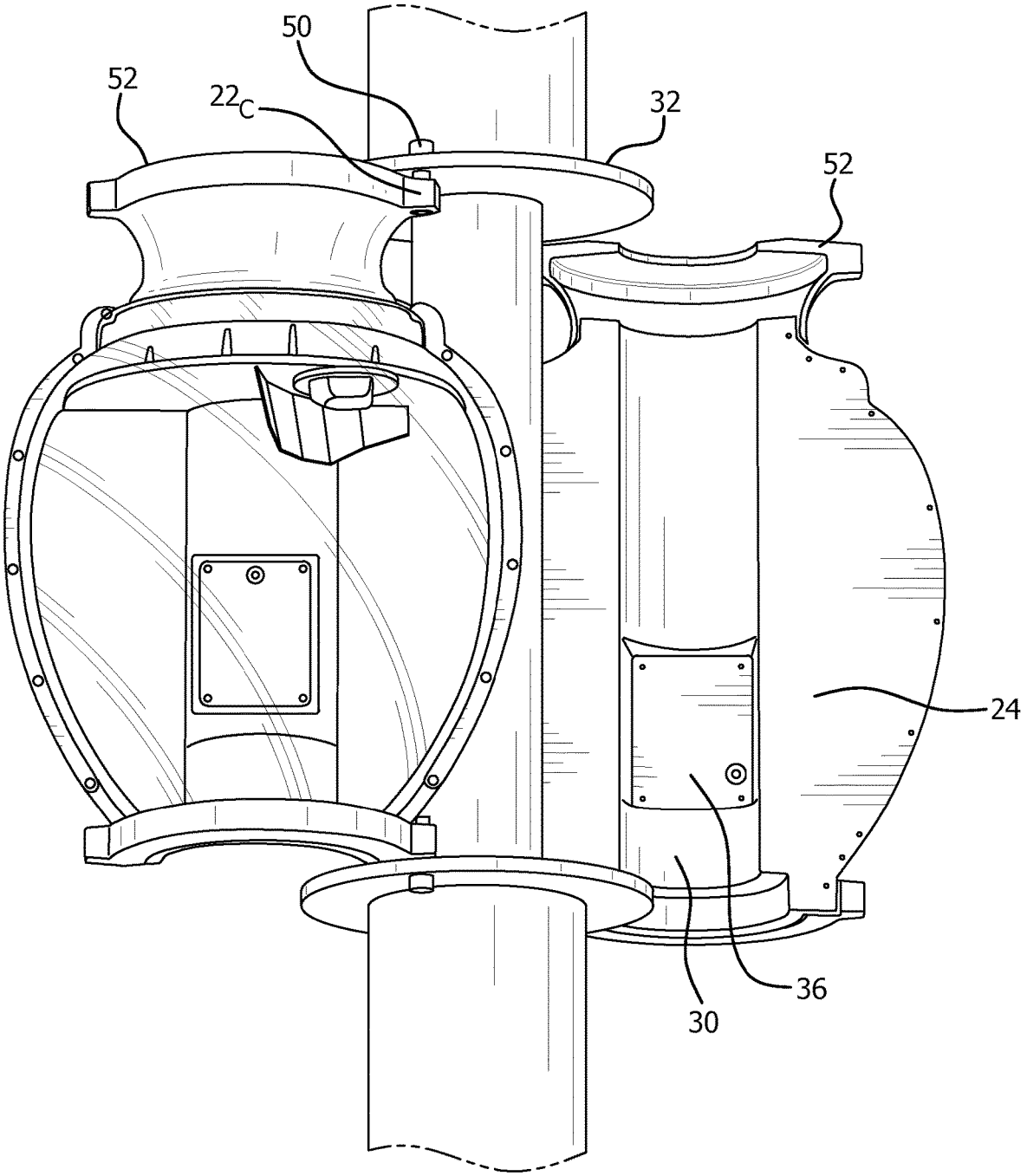
FIG. 6 is a perspective view of the light pole assembly with the split luminaire in its open position.

In a preferred embodiment, a tube or tubular support 34 mounts to the top of the pole 12 and is configured to extend through the conduit 31 to above the luminaire. The tubular support 32 is designed to provide structural support for components mounted above the luminaire, as well as support the luminaire 14 (i.e., provide a structure onto which the luminaire mounts. The tubular support 34 is hollow so as to permit wiring to pass through to the components mounted above the luminaire, as well as providing for wiring to the light sources inside the luminaire. The tubular support 34 includes flanges 32 on the top and bottom of the tubular support center portion 34C. The flanges 32 provide mounting points for attaching the luminaire to the top of the pole. Specifically as shown in FIG. 6, each housing 22 is hingedly attached to the top and bottom flanges 32. At least one upper and one lower corner 22C of each housing 22 includes a hole that receives a bolt 50 that extends through a hole in each flange 32. The bolts 50 are vertically aligned so as to provide a hinge axis about which the housing 22 can rotate. In one embodiment, each housing 22 includes a housing cap 52 that is mounted to (or formed integral with) the top of the housing 22. In this embodiment the hole in the housing 22 through which the bolt extends is formed in the cap 52, providing a stronger support for the housing 22 mount to the flange 32.

As discussed above, the top flange 32 provides a mounting surface for electrical components that are located above the luminaire, such as antenna or other electrical transmitters and/or receivers. Seals 33 may be included to attach a portion of the cover 20 to the flanges 32 of the tube 34 to prevent water entry into the luminaire or the pole. In the illustrated embodiment, the flanges 32 are located on and attached to (or formed integral with) opposite ends of the tubular support 34. The center section 34C of the tubular support sits within the conduit 31 and preferably has an inner diameter of about four inches to fit the necessary wiring. The tube and flanges can be made from a suitable strong material such as aluminum or steel, for providing the structural support for the electrical component, thus eliminating or reducing the need for luminaire housing 22 to provide support for the top mounted electrical components. It should be readily apparent that the tubular support 34 is not needed and the flanges 32 could be formed on the upper and lower ends of the housing. However, the use of a tube 34 permits the housing and luminaire to be lighter since the housing does not need to carry the loads of the components located above the luminaire. In addition, the incorporation of the tubular support 34 permits for ease of assembly by allowing the electrical components to be assembled onto the tube prior to installation.

Figure 5:
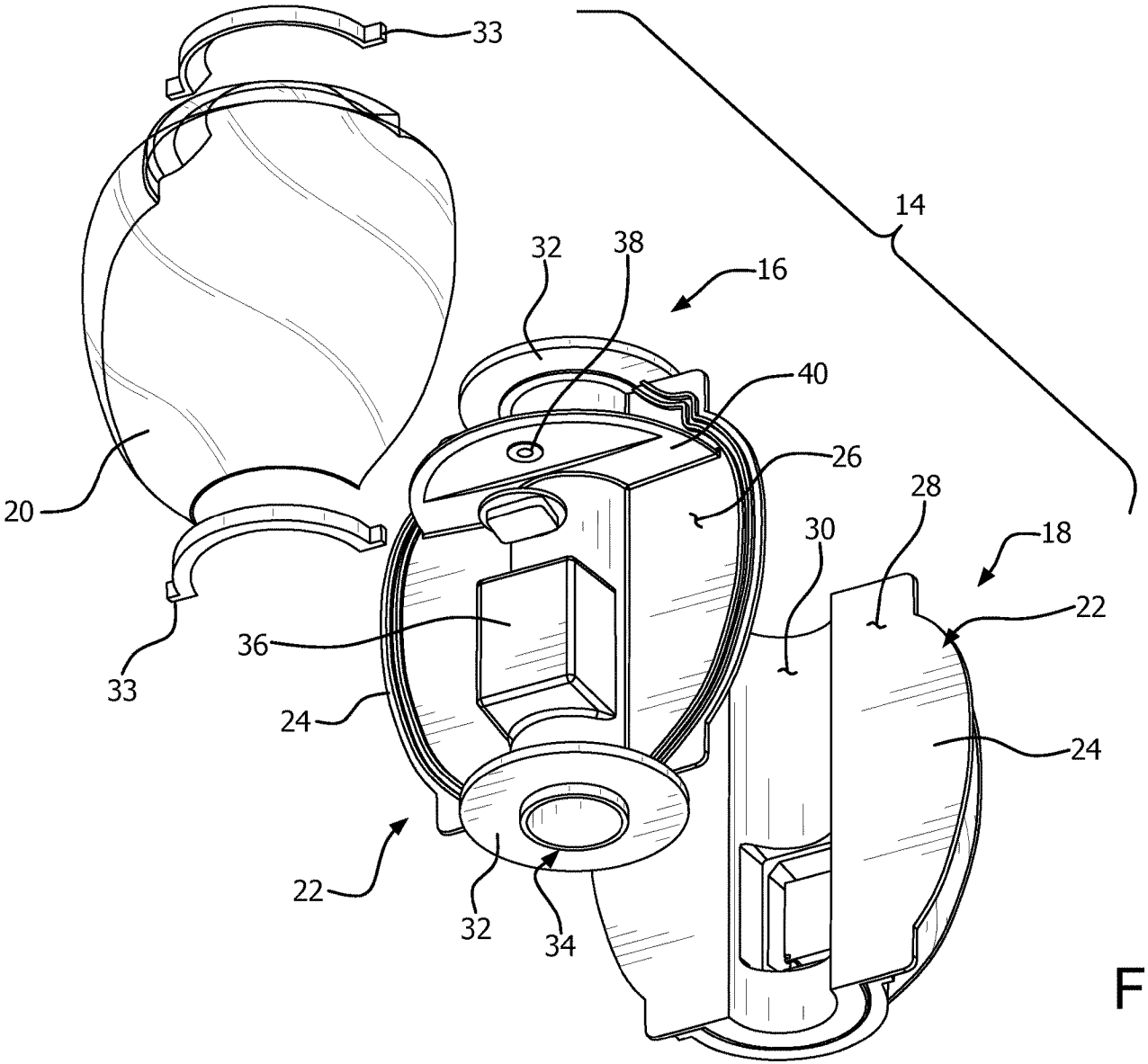
FIG. 5 is an exploded view of the split luminaire of FIG. 1.

As shown in FIG. 5, the recesses 30 in the luminaire sections may include chambers 36 formed in the housings for mounting electrical components, such as LED drivers, that may be necessary for controlling or powering the light sources in the luminaire. One or more light sources 38 are mounted in the luminaire. The light sources may be LED arrays. In the illustrated embodiment, the light sources 38 are mounted on a shelf 40 or bracket extending laterally outward from the back portion 24 of the housing 22.

It is also contemplated that, instead of the luminaire mounting to the top of the pole, each of the sections 16, 18 of the luminaire 14 may attach to a side of the pole near the top such that the pole extends through the conduit 31. In such a configuration, the tubular support 34 is not needed and the flanges 32 would be attached to an upper portion of the pole. In this embodiment, the electrical components attach directly to the top of the pole and the electronics and communications pass through the pole. Power for the light sources in the luminaire would extend through a hole or opening in the side of the pole where the luminaire mounts.

In the illustrated embodiment, the housing 22, preferably including the shelves or brackets 40 that extend laterally outward from the back portion 24 of the housing 22 and which support the light sources 38, is made from a one piece cast body which provides for increased heat dissipation. The use of LEDs can lead to increased heat generation, the housing acts as a heat sink, channeling the heat away from the LEDs. As shown in the figures, the housings 22 includes edges 22E that are preferably exposed to the ambient atmosphere. This permits heat dissipation to the outside air.

The split construction of the luminaire permits each section to be designed so that it is individually sealed, thereby preventing water infiltration into each section. As such, each section of the luminaire operates independently of the other and, thus, one section can be under maintenance while the other operates normally.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

The invention claimed is:

1. A split luminaire for mounting on top of a post, the luminaire comprising:

at least two sections that attach to one another, each section including an outer light transmitting cover which is at least partially transparent or translucent, and a housing, the cover being removably attached to the housing, the housing having a back partition with a front side and a rear side, the front side facing outward toward the cover;

the rear side of the partition in at least one of the housings including a recess that extends upward from a bottom edge of the housing to a top edge of the housing, the recess forming a channel though the housing, wherein when the housings are assembled the channel defines a conduit through the assembled housings and the luminaire, the conduit being open on its top and bottom, the conduit configured to permit wiring, cabling and/or other components to extend through the luminaire to the top edge of the housings;

one or more light sources mounted within the luminaire and positioned to emit light toward the cover; and a tubular support located between the two housings and extending through the conduit, the tubular support having a upper and lower flanges extending radially outward, the upper flange being located on or above a top of the luminaire and the lower flange being located below a bottom of the luminaire, and the upper flange configured for attachment of electrical components above the luminaire, wherein the tubular support is hollow for permitting wiring to extend therethrough, and wherein each housing is hingedly attached to the tubular support.

2. The split luminaire of claim 1, further comprising seals located between each cover and the bottom flange to prevent water entry into the luminaire.

3. The split luminaire of claim 1, wherein each housing has a channel formed in its rear side and wherein when assembled the housings form, in combination, the conduit through the luminaire.

4. The split luminaire of claim 3, wherein the housings of the sections are substantially identical to one another.

5. The split luminaire of claim 4, wherein the cover is made from glass or plastic material.

6. The split luminaire of claim 5, wherein the front side of the back partition of the housing is coated with a white or reflective material to facilitate light reflection.

7. The split luminaire of claim 1, wherein each housing includes one or more chambers for mounting electrical components.

8. The split luminaire of claim 1, wherein the one of more light sources are LED arrays mounted on a shelf or bracket extending laterally outward from the back partition of at least one housing, and wherein the shelf and the housing provide heat dissipation for the LED arrays, the housing having an outer edge that is exposed to the ambient environment outside of the cover for channeling heat to the ambient.

9. A light post assembly for permitting wiring and other electrical components and communications to extend through a top-mounted luminaire, the assembly comprising:

a long hollow pole adapted to be mounted to an electrical base cabinet, the pole including an open top which permits wiring, cabling or other electrical or power transmission or communication to pass out from an interior of the pole;

a split luminaire having at least two sections that attach to one another, each section including an outer light transmitting cover which is at least partially transparent or translucent, and a housing, the cover being removably attached to the housing, the housing having a back partition with a front side and a rear side, the front side facing outward toward the cover;

the rear side of the partition in at least one of the housings including a recess that extends upward from a bottom edge of the housing to a top edge of the housing, the recess forming a channel though the housing, wherein when the housings are assembled the channel defines a conduit through the assembled housings and the luminaire, the conduit being open on its top and bottom, a tubular support mounted to the top of the pole, the tubular support being located within the conduit of the luminaire and configured to permit wiring, cabling and/or other components to extend from the pole through the luminaire to the top edge of the housings, the tubular support including upper and lower flanges that extend laterally outward from a center portion, the upper flange being located on or above a top of the luminaire and the lower flange being located below a bottom of the luminaire, the lower flange attached to a flange on the pole top, and the upper flange configured for attachment of electrical components above the luminaire;

wherein the housings are hinged to the upper and lower flanges such at each housing can be independently pivoted away from the tubular support to an open position for accessing any wiring; and one or more light sources mounted within the luminaire and positioned to emit light toward the cover.

10. The light post assembly of claim 9, further comprising seals located between each cover and the bottom flanged mount to prevent water entry into the luminaire or the pole.

11. The light post assembly of claim 9, wherein each housing has a channel formed in its rear side and wherein when assembled the housings form, in combination, the conduit through the luminaire.

12. The light post assembly of claim 11, wherein the housings of the sections are substantially identical to one another.

13. The light post assembly of claim 12, wherein the cover is made from glass or plastic material.

14. The light post assembly of claim 13, wherein the front side of the back partition of the housing is coated with a white or reflective material to facilitate light reflection.

15. The light post assembly of claim 9, wherein the each housing includes one or more chambers for mounting electrical components.

16. The light post assembly of claim 9, wherein the one of more light sources are LED arrays mounted on a shelf or bracket extending laterally outward from the back partition of at least one housing, and wherein the shelf and the housing provide heat dissipation for the LED arrays, the housing having an outer edge that is exposed to the ambient environment outside of the cover for channeling heat to the ambient.

17. A light post assembly for permitting wiring and other electrical components and communications to extend through a top-mounted luminaire, the assembly comprising:

a long hollow pole adapted to be mounted to an electrical base cabinet, the pole including an open top which permits wiring, cabling or other electrical or power transmission or communication to pass out from an interior of the pole;

a split luminaire having at least two sections that attach to one another, each section including an outer light transmitting cover made from glass or plastic material which is at least partially transparent or translucent, and a housing;

the cover being removably attached to the housing, the housing having a back partition with a front side and a rear side, the front side facing outward toward the cover and being coated with a white or reflective material to facilitate light reflection;

the rear side of each of the partitions including a recess that extends upward from a bottom edge of the housing to a top edge of the housing, each recess forming a channel though the housing, the channels of the housings in combination defining a conduit through the assembled housings and the luminaire, the conduit being open on its top and bottom;

a hollow tube located within and extending through the conduit and having an upper flange and a lower flange, the upper flange being located above a top of the luminaire and the lower flange being located below a bottom of the luminaire, the lower flange attached to a flange on a top of the pole, and the upper flange configured for attachment of electrical components above the luminaire, wherein the tube provides structural support for electrical components mounted above the luminaire;

seals located between each cover and the bottom flange to prevent water entry into the luminaire or the pole; and a plurality of LED light sources mounted within the luminaire and positioned to emit light toward the cover, at least one of the light sources being mounted on a shelf or bracket extending laterally outward from the back partition of at least one housing, the shelf or bracket having an angled mounting surface upon which the light source is mounted so as to emit light in at least a downward direction.

* * * * *